US007451741B1

(12) United States Patent
Bartley et al.

(10) Patent No.: US 7,451,741 B1
(45) Date of Patent: Nov. 18, 2008

(54) HIGH-PRESSURE PUMP

(75) Inventors: Bradley E. Bartley, Pekin, IL (US); Scott F. Shafer, Morton, IL (US); Steven Y. Tian, Bloomington, IL (US); Timur T. Trubnikov, Peoria, IL (US); Christopher R. Jones, Peoria, IL (US); Haithem Algousi, Peoria, IL (US)

(73) Assignee: Caterpillar Inc., Peoria, IL (US)

( * ) Notice: Subject to any disclaimer, the term of this patent is extended or adjusted under 35 U.S.C. 154(b) by 0 days.

(21) Appl. No.: 11/981,109

(22) Filed: Oct. 31, 2007

(51) Int. Cl.
*F02M 37/04* (2006.01)
*F02M 69/04* (2006.01)
*F04B 39/00* (2006.01)

(52) U.S. Cl. ..... 123/445; 123/506; 417/454

(58) Field of Classification Search ..... 123/446, 123/447, 456, 506, 445; 417/273, 454
See application file for complete search history.

(56) References Cited

U.S. PATENT DOCUMENTS 4,385,614 A * 5/1983 Eheim et al. ..... 123/506
4,586,480 A * 5/1986 Kobayashi et al. ..... 123/506
4,869,219 A * 9/1989 Bremmer et al. ..... 123/383
4,878,815 A * 11/1989 Stachowiak ..... 417/63
4,940,036 A * 7/1990 Duplat ..... 123/506
5,058,553 A 10/1991 Kondo et al.
5,094,216 A 3/1992 Miyaki et al.
5,197,438 A 3/1993 Kumano et al.
5,636,975 A * 6/1997 Tiffany et al. ..... 417/454
5,676,114 A * 10/1997 Tarr et al. ..... 123/446
5,957,674 A * 9/1999 Zenmei et al. ..... 417/505
6,045,120 A * 4/2000 Tarr et al. ..... 251/282
6,224,350 B1 * 5/2001 Guentert et al. ..... 417/273
6,705,846 B2 * 3/2004 Greiff et al. ..... 417/560
7,121,812 B2 * 10/2006 Forrest ..... 417/269
7,198,033 B2 * 4/2007 Inaguma et al. ..... 123/506
7,198,034 B2 * 4/2007 Ausiello et al. ..... 123/506
7,290,559 B2 * 11/2007 Nieslony et al. ..... 137/454.4
7,367,789 B2 * 5/2008 Raghavan et al. ..... 417/571

* cited by examiner

*Primary Examiner*—Thomas N Moulis
(74) *Attorney, Agent, or Firm*—Mathew P. Anderson

(57) ABSTRACT

The pump described herein provides a potentially lower cost alternative to conventional high-pressure pumps by providing a head, a plunger, and a control valve assembly. The head defines a valve bore having a first diameter, a plunger bore having a second diameter, and an intermediate chamber having a third diameter. The plunger is configured to reciprocate within the plunger bore. The plunger, the plunger bore, and the intermediate chamber at least partially define a pumping chamber. The control valve assembly is coupled to the head and includes an actuator moveable in response to an input signal and a valve element coupled to the actuator. The valve element is received within the valve bore and moveable between an open and a closed position. The valve element includes a body having a fourth diameter and a valve head having a fifth diameter. The first diameter is no larger than the second diameter.

24 Claims, 3 Drawing Sheets

HIGH-PRESSURE PUMP

TECHNICAL FIELD

The present disclosure relates to fluid pumps. More particularly, the present disclosure relates to high-pressure fuel pumps for use in fuel systems.

BACKGROUND

Many of today's diesel engines are utilizing a common rail fuel system that relies on a high-pressure pump to achieve the desired injection pressures. As the desired injection pressures increase, it becomes increasingly more important to provide an efficient pump. One factor that has a negative effect on pump efficiency is the unintended leakage of highly pressurized fuel into a low-pressure area or drain. However, as injection pressures become higher, it becomes more difficult to maintain completely sealed interfaces between interacting components, as the higher pressures often cause leakage that would not otherwise have occurred at lower pressures. One factor that may contribute to leakage is the misalignment of interacting components, such as components that seat against one another. As the pressures increase, the degree of misalignment that will result in a leak becomes smaller and smaller, making it increasingly more difficult to mass produce pumps that have such interacting components.

Although modern machinery and manufacturing processes may allow manufacturers to manufacture precision parts that achieve the necessary degrees of alignment, those parts tend to be more expensive than parts that allow for greater tolerances during manufacture. Generally, the more sealing interfaces that are included within a pump that are exposed to high pressures, such as the pressures generated in modern common rail fuel systems, the more precision parts or components will be required. The need for a greater number of precision parts generally leads to an increased overall cost of the pump. Not only does the need for precision parts increase cost, but the need for more parts in general, also often leads to increased cost.

One example of a common rail pump is described in U.S. Pat. No. 5,058,553, issued Oct. 22, 1991 ("the '553 patent"). The pump described in the '553 patent includes a housing and a cylinder fitted in the housing. The housing includes a cam chamber through which a cam shaft extends. The cylinder includes a slide hole that accommodates a plunger that is reciprocatively moved within the slide hole by the cam shaft. The plunger and the slide hole define a plunger chamber in which low-pressure inlet fuel is pressurized. An electromagnetic valve is screwed into the cylinder and serves as a component through which the low-pressure fuel inlet communicates with the plunger chamber. The electromagnetic valve includes a body, an armature, and a valve plug that moves with the armature between an open and a closed position. When the valve plug is in the closed position, it engages a seat on the body to close off the plunger chamber from the low-pressure inlet fuel. To avoid the leakage of high pressure fuel from the plunger chamber into a low pressure area or drain, leakage will likely have to be avoided between the body of the valve and the cylinder, between the valve plug and the corresponding seat on the valve body, and between the plunger and the slide hole. Thus, there are at least three potential leak paths that need to be addressed, most likely through the use of multiple high precision and relatively costly parts.

It would be desirable to provide a high-pressure pump that is able to overcome one or more of the shortcomings described above.

SUMMARY

According to one exemplary embodiment, a pump comprises a housing, a driven member coupled to the housing, a head, a plunger, and a control valve assembly. The head is coupled to the housing and defines a valve bore having a first diameter, a plunger bore having a second diameter, and an intermediate chamber having a third diameter. The intermediate chamber is located between the valve bore and the plunger bore. The plunger is configured to reciprocate within the plunger bore. The plunger, the plunger bore, and the intermediate chamber at least partially define a pumping chamber. The control valve assembly is coupled to the head. The control valve assembly includes an actuator moveable in response to an input signal and a valve element coupled to the actuator. The valve element is received within the valve bore and is moveable between an open position and a closed position. The valve element includes a body having a fourth diameter and a valve head having a fifth diameter. The first diameter is no greater than the second diameter.

According to another exemplary embodiment, a method of assembling a pump comprises the step of providing a head having a valve bore, a plunger bore, and an intermediate chamber between the valve bore and the plunger bore. The method also comprises the step of providing a valve element including a body and a valve head. The method also comprises the step of installing the valve element within the head by sliding the body of the valve element into the plunger bore, then into the intermediate chamber, and then into the valve bore so that when the valve element is installed, the valve body is received within the valve bore and the head of the valve element is received within the intermediate chamber.

DETAILED DESCRIPTION

Figure 1:
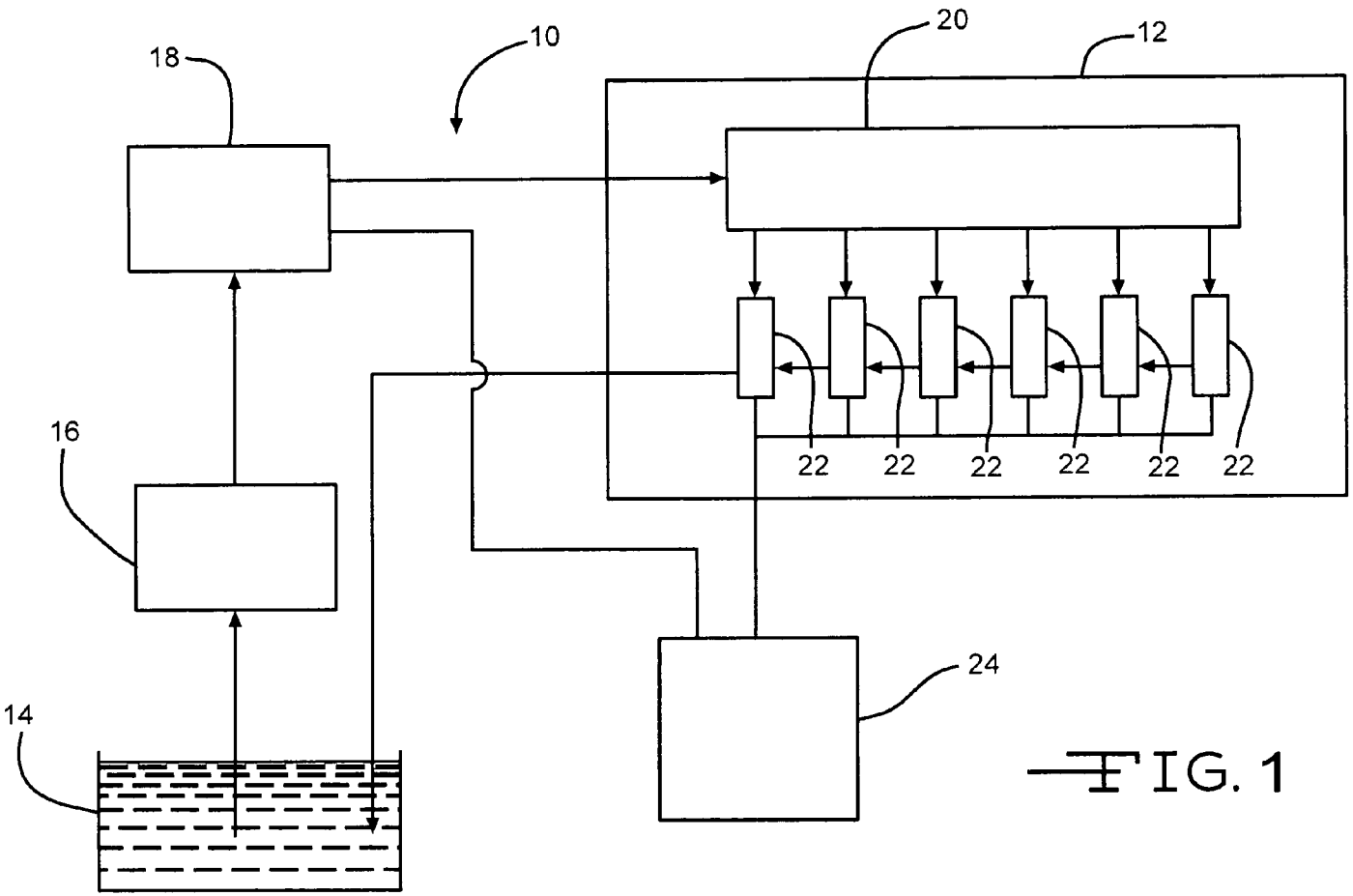
FIG. 1 is a schematic illustration of a fuel system according to one exemplary embodiment.

Referring generally to FIG. 1, a fuel system 10 is shown according to one exemplary embodiment. Fuel system 10 is a system of components that cooperate to deliver fuel (e.g., diesel, gasoline, heavy fuel, etc.) from a location where fuel is stored to the combustion chamber(s) of an engine 12 where it will combust and where the energy released by the combustion process will be captured by engine 12 and used to generate a mechanical source of power. Although depicted in FIG. 1 as a fuel system for a diesel engine, fuel system 10 may be the fuel system of any type of engine (e.g., internal combustion engine such as a diesel or gasoline engine, a turbine, etc.). According to one exemplary embodiment, fuel system 10 includes a tank 14, a transfer pump 16, a high-pressure pump 18, a common rail 20, fuel injectors 22, and an electronic control module (ECM) 24.

Tank 14 is a storage container that stores the fuel that fuel system 10 will deliver. Transfer pump 16 pumps fuel from tank 14 and delivers it at a generally low pressure to high-pressure pump 18. High-pressure pump 18, in turn, pressurizes the fuel to a high pressure and delivers the fuel to common rail 20. Common rail 20, which is intended to be maintained at the high pressure generated by high-pressure pump 18, serves as the source of high-pressure fuel for each of fuel injectors 22. Fuel injectors 22 are located within engine 12 in a position that enables fuel injectors 22 to inject high-pressure fuel into the combustion chambers of engine 12 (or into pre-chamber or ports upstream of the combustion chamber in some cases) and generally serve as metering devices that control when fuel is injected into the combustion chamber, how much fuel is injected, and the manner in which the fuel is injected (e.g., the angle of the injected fuel, the spray pattern, etc.). Each fuel injector 22 is continuously fed fuel from common rail 20 such that any fuel injected by a fuel injector 22 is quickly replaced by additional fuel supplied by common rail 20. ECM 24 is a control module that receives multiple input signals from sensors associated with various systems of engine 12 (including fuel system 10) and indicative of the operating conditions of those various systems (e.g., common rail fuel pressure, fuel temperature, throttle position, engine speed, etc.). ECM 24 uses those inputs to control, among other engine components, the operation of high-pressure pump 18 and each of fuel injectors 22. The purpose of fuel system 10 is to ensure that the fuel is constantly being fed to engine 12 in the appropriate amounts, at the right times, and in the right manner to support the operation of engine 12.

Figure 2:
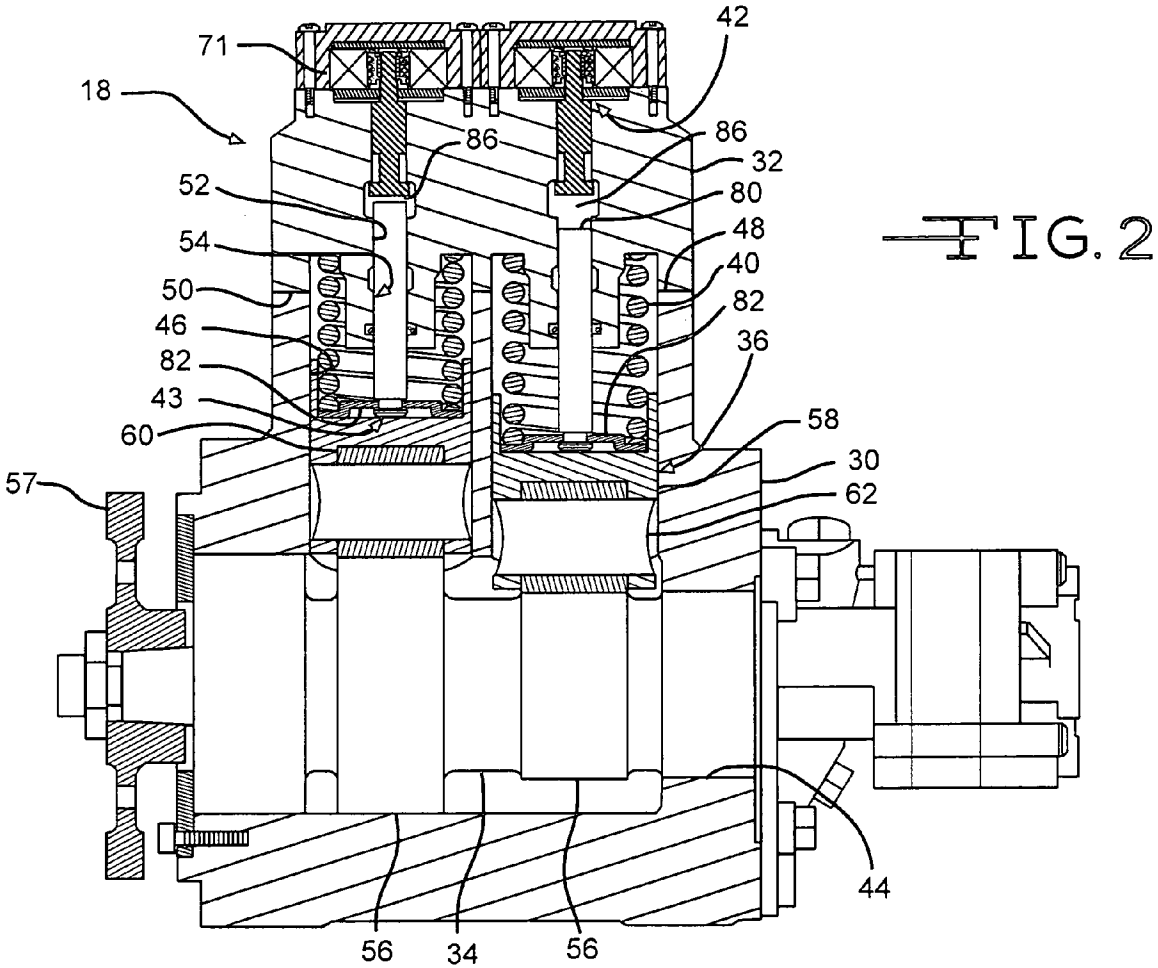
FIG. 2 is a cross-sectional side view of a pump including a head assembly according to one exemplary embodiment.

Referring now to FIG. 2, high-pressure pump 18 is configured to increase the pressure of the fuel from a pressure that is sufficient to transfer the fuel from the tank to a pressure that is desirable for the injection of the fuel into the combustion chambers of engine 12 (or injection elsewhere). Such injection pressures may vary between different applications, but often range between approximately 1500 bar and 2000 bar, and may include pressures that are below 1500 bar or above 2000 bar. According to one exemplary embodiment, pump 18 includes a housing 30, a head 32, a camshaft 34, two tappet assemblies 36, two resilient members 40, two plunger assemblies 43, and two control valve assemblies 42.

Housing 30 is a rigid structure that generally serves as the base of pump 18. Housing 30 includes a central bore 44 that is configured to receive camshaft 34, as well as two spaced-apart, parallel tappet bores 46 that are each configured to receive at least a portion of a tappet assembly 36, a plunger assembly 43, a resilient member 40, and head 32. The axis of each tappet bore 46 is arranged perpendicularly (or radially) to the axis of central bore 44 such that the rotation of camshaft 34 within central bore 44 causes tappet assemblies 36 to translate in a linear, reciprocating manner within tappet bores 46. Near the distal ends of tappet bores 46, housing 30 also includes a face 48 that is configured to receive head 32.

Figure 3:
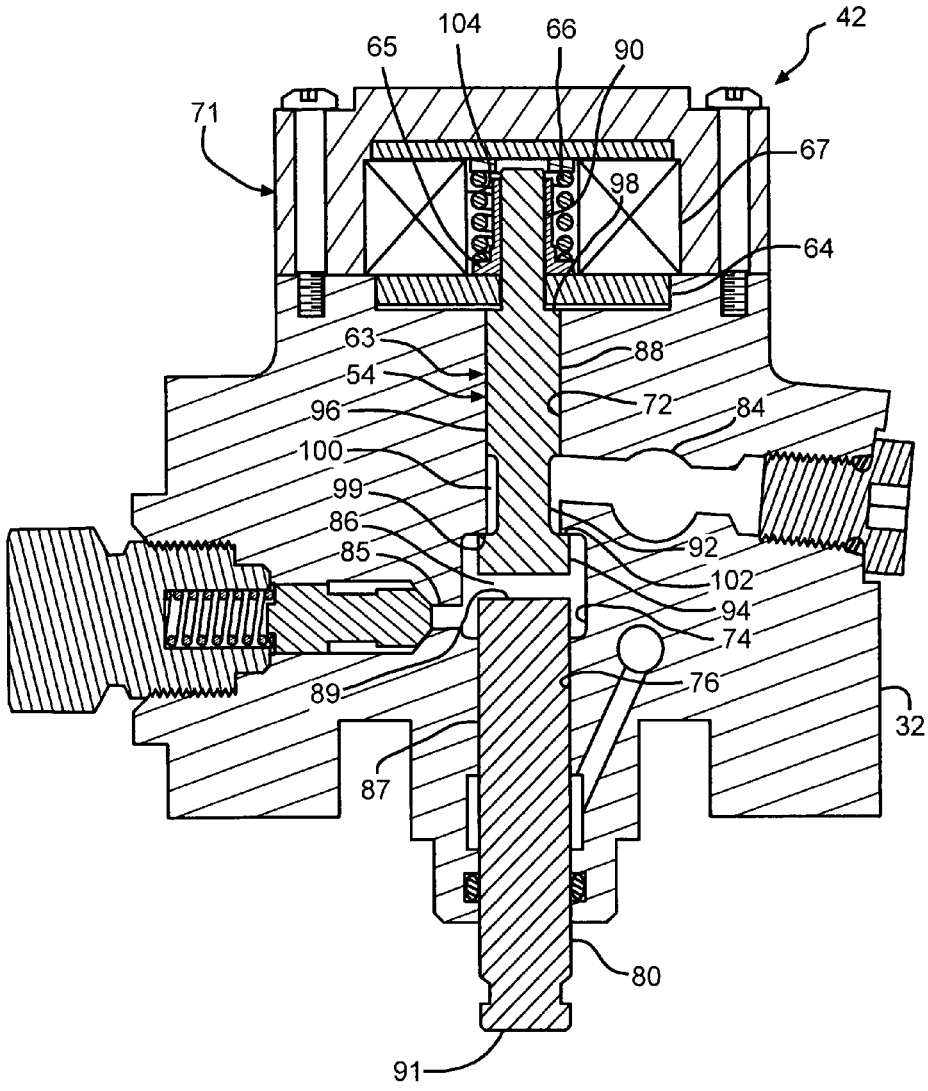
FIG. 3 is a cross-sectional end view of the head assembly of FIG. 2.

Head 32 is coupled to face 48 of housing 30 and generally serves, among other things, to enclose tappet bores 46, provide a portion of the structure defining pumping chambers 86 (discussed below), receive control valve assemblies 42, and provide various ports and ducts to direct the flow of fuel into and out of pumping chambers 86. Head 32 includes a face 50 that cooperates with face 48 of housing 30 (and optionally a sealing element such as an o-ring) to provide a sealed interface between head 32 and housing 30. As illustrated in FIG. 3, head 32 also includes a fuel inlet passage 84 that is coupled to transfer pump 16 and a fuel outlet passage 85 that is coupled to common rail 20. Head 32 also includes two apertures 54, each of which is configured to receive a portion of control valve assembly 42 and a portion of plunger assembly 43. Each aperture 54 includes three regions, region 72, region 74, and region 76. Region 72 defines a valve bore that is configured to closely receive and guide a portion of control valve assembly 42. Region 74 defines an intermediate chamber and is located between region 72 and 76. Region 74, in combination with a portion of valve assembly 42, a portion of plunger assembly 43 and region 76, defines pumping chamber 86. Region 76 defines a plunger bore that is configured to receive a portion of plunger assembly 43. According to one exemplary embodiment, the diameter of region 74 is larger than the diameter of region 76, which in turn is larger than the diameter of region 72. According to various alternative and exemplary embodiments, the relative sizes of the different regions of aperture 54 may vary. For example, region 74 and region 76 may have the same diameter, which is larger than the diameter of region 72. According to one exemplary embodiment, head 32 is integrally formed as a single unitary body. However, according to various alternative and exemplary embodiments, the head may be formed from two or more different pieces or elements coupled together.

Camshaft 34 is a driven member that is formed from an elongated shaft that includes two sets of cam lobes 56 that are spaced apart along the length of camshaft 34 and a gear or pulley 57 on one of its two ends. Gear or pulley 57 is a driven member that is configured to engage another member, such as another gear, a chain, or a belt, that is driven, either directly or indirectly, by engine 12. The two sets of cam lobes 56 are spaced apart along the length of camshaft 34 so as to correspond with each of the two tappet assemblies 36. According to various exemplary and alternative embodiments, each set of cam lobes 56 may include a single cam lobe, two cam lobes, three cam lobes, or more than three cam lobes, with each cam lobe representing a complete pumping and filling cycle. According to other various alternative and exemplary embodiments, the two sets of cam lobes may be in phase with one another (such that the cam lobes of the first cam lobe set will pass under head 32 at the same time as the corresponding cam lobes of the second cam lobe set) or they may be out of phase with one another (such that the cam lobes of the first cam lobe set will pass under head 32 at different times than the corresponding cam lobes of the second cam lobe set). According to other various alternative and exemplary embodiments, the extent to which the cam lobes of the first cam lobe set may be out of phase relative to the cam lobes of the second cam lobe set may vary depending on the application of pump 18 and other factors.

Referring still to FIG. 2, each tappet assembly 36 (also sometimes referred to as a lifter assembly) is configured to engage one of the two sets of cam lobes 56, transform the rotational movement of the corresponding cam lobes 56 into linear movement, and transfer such linear movement to the corresponding plunger assembly 43. Each tappet assembly 36 includes a body 58 that engages and receives a portion of plunger assembly 43, a roller 60 that engages and follows a set of cam lobes 56, and a pin 62 that couples roller 60 to body 58. Body 58 is received within the corresponding tappet bore 46 of housing 30 and translates back and forth within tappet bore 46 as camshaft 34 rotates.

Resilient member 40, shown as a compression spring, is an element or member that serves to bias the corresponding plunger assembly 43 and tappet assembly 36 toward camshaft 34. By biasing both the corresponding plunger assembly 43 and tappet assembly 36 toward camshaft 34, resilient member 40 helps to ensure that plunger assembly 43 returns to its lowest position (hereinafter referred to as "bottom dead center") before camshaft 34 completes another rotation (or partial rotation, depending on the cam lobe configuration) and forces plunger assembly 43 back up to its highest position (hereinafter referred to as "top dead center"). This helps to ensure that plunger assembly 43 is performing a complete filling cycle (the cycle where plunger assembly 43 moves from top dead center to bottom dead center) and a complete pumping cycle (the cycle where plunger assembly 43 moves from bottom dead center to top dead center) for each cam lobe 56 in the corresponding cam lobe set of camshaft 34.

Plunger assembly 43 is an assembly of components that is located generally between the corresponding tappet assembly 36 and head 32 and that reciprocate with tappet assembly 36 relative to head 32 to pressurize the fluid within pumping chamber 86. According to one exemplary embodiment, plunger assembly 43 includes a plunger 80 and a retainer 82. Plunger 80 is a member (e.g., piston, shaft, rod, element, retained member) that is configured to reciprocate or slide within region 76 of aperture 54 of head 32 as the corresponding tappet assembly 36 reciprocates within tappet bore 46 of housing 30. According to one exemplary embodiment, plunger 80 includes an elongated, generally cylindrical body 83 having a side wall 87, a first end 89 that is configured to extend into region 76 of aperture 54, and a second end 91 located near tappet assembly 36. First end 89, regions 76 and 74 of aperture 54, and a portion of control valve assembly 42 define pumping chamber 86, the volume of which changes as plunger 80 moves back and forth, or up and down, within region 76 of aperture 54. Retainer 82 is a component or an assembly of components that couple to plunger 80 and that serve to apply at least a portion of the force provided by resilient member 40 to plunger 80.

Referring now to FIGS. 2 and 3, each control valve assembly 42 generally serves to control the fluid communication between pumping chamber 86 (discussed below) and the fuel being provided by transfer pump 16, and therefore is capable of controlling the amount of fuel that enters pumping chamber 86 during the filling cycle and the amount of fuel that remains in pumping chamber 86 during the pumping cycle. According to a first exemplary embodiment, control valve assembly 42 includes a valve element 63 and an actuator 71.

Valve element 63 is moveable between on open position in which fuel inlet passage 84 is fluidly connected to pumping chamber 86 and a closed position in which fuel inlet passage 84 is not fluidly connected to, or is sealed off from, pumping chamber 86. According to one exemplary embodiment, valve element 63 extends through regions 72 and 74 of aperture 54 and includes a body 88, an armature interface 90, a stem 92, and a head 94. Body 88 is a generally cylindrical portion of valve element 63 and defines a guide surface 96 that cooperates with region 72 of aperture 54 to guide the movement of valve element 63 as valve element slides or reciprocates within region 72. To minimize any fluid leakage that may occur between the surface defining region 72 and body 88, the gap between them may be minimized. Armature interface 90 extends from one end of body 88 and receives a portion of actuator 71 (e.g., armature 64 and sleeve 75, described below). Armature interface 90 may be threaded to facilitate the coupling of armature 64 and/or or sleeve 65 to valve element 63, or armature interface 90 may be configured in any one of a variety of different ways to facilitate the engagement of armature 64 and sleeve 65 with valve element 63. For example armature interface 90 may be configured so that either or both of armature 64 and sleeve 65 freely slide over armature interface 90, may be press fit onto armature interface 90, or engage armature interface 90 in any one of a variety of other ways. A shoulder 98 is formed where armature interface 90 extends from body 88 and serves to provide a positive stop for armature 64 and to help align armature 64. Stem 92 extends from the opposite end of body 88 and has a diameter that is less than that of body 88. The reduced diameter of stem 92, in combination with region 72 of aperture 54 defines a chamber 100 (e.g., a flow chamber) that enables fluid to flow between valve element 63 and region 72 of aperture 54 of head 32 when valve element 63 is in the open position. Head 94 is coupled to the distal end of stem 92 and forms a cap-like structure having a diameter that is larger than the diameter of stem 92 and body 88. The larger diameter of head 94 allows it to engage a sealing surface 99 of head 32 located between region 72 and region 74 of aperture 54. Head 94 includes a sealing surface 102 that extends perpendicularly and radially outward from the distal end of stem 92 and that is configured to engage sealing surface 99 of head 32 when valve element 63 is in the closed position to substantially seal off pumping chamber 86 from inlet passage 84. According to various alternative and exemplary embodiments, valve element 63 may take one of a variety of different configurations. For example, the relative sizes of the different portions of valve element 63 may vary depending on the application (e.g., the diameter of the head may be the same size as or smaller than the diameter of the body, the diameter of the stem may be the same size as the diameter of the body, etc.), the orientation of the sealing surface may vary (e.g., it may be substantially perpendicular to a longitudinal axis of the valve element, or it may be oriented at an acute or obtuse angle relative to the longitudinal axis), and/or the shape or configuration of the sealing surface may vary (e.g., it may be flat, it may form a knife edge, it may be curved, it may have one or more flat, curved, and/or pointed portions, etc.).

When valve element 63 is moved into the closed position, sealing surface 102 of head 94 is moved into contact with sealing surface 99 of head 32 and creates a sealed interface that is intended to prevent, or substantially prevent, the flow of fluid between chamber 100 and pumping chamber 86. When valve element 63 is moved into the open position, sealing surface 102 of head 94 is moved away from sealing surface 99 of head 32, which then allows for the flow of fluid between chamber 100 and pumping chamber 86. Thus, the sealed interface between sealing surface 102 of head 94 and sealing surface 99 of head 32 is engaged when valve element 63 is in the closed position and disengaged when valve element 63 is in the open position.

According to one exemplary embodiment, valve element 63 is assembled within head 32 by inserting armature interface 90 of valve element 63 into region 76 of aperture 54 and then continuing to slide valve element 63 through regions 76 and region 74 of aperture 54 until body 88 is received within region 72 and head 94 located with region 74. To accomplish this, the diameter of region 76 should be greater that the largest diameter of valve element 63, which according to one exemplary embodiment is the diameter of head 94. Similarly, in order to receive head 94, the diameter of region 74 should be at least as large as head 94. However, in order to allow inlet fuel to flow from chamber 100 to pressure chamber 86, there should be a flow path between head 94 and region 74 that can be closed when valve element 63 is in the closed position. According to one exemplary embodiment, the flow path is provided by making the diameter of region 74 larger than that of head 94. According to other alternative and exemplary embodiments, the head of the valve element and/or the surface defining region 74 may include one or more flats or slots that allow fluid to flow between the head and the region 74. In order to provide a surface valve element 63 may engage to seal of chamber 100 from pumping chamber 86 when valve element 63 is in the closed position, the diameter of region 72 is smaller than the diameter of head 94. According to various alternative and exemplary embodiments, the relative sizes of the valve element and the regions of the aperture within the head may vary depending on the situation.

Actuator 71 is an electronically controlled device that generates movement in response to an electric signal. Within control valve assembly 42, actuator 71 serves to move valve element 63 relative to head 32 (specifically, the valve bore defined by region 72 of aperture 54). According to one exemplary embodiment, actuator 71 includes an armature 64, a sleeve 65, a biasing member 66, and a solenoid 67. Armature 64 is a disk-like element that includes an aperture that receives armature interface 90 of valve element 63. A sleeve or retainer shown as sleeve 65 may be provided to secure armature 64 to valve element 63. For example, sleeve 65 may include a threaded interface that engages a threaded interface provided on armature interface 90 of valve element 63. Armature 64 may then be secured to valve element 63 by tightening sleeve 65 onto armature interface 90 and forcing armature 64 against shoulder 98 of valve element 63. Solenoid 67 is coupled to the top of head 32 such that a portion of valve element 63 extends through an aperture 104 extending at least partially through solenoid 67. Biasing member 66, shown as a compression spring, is located within aperture 104 and receives a portion of valve element 63 and sleeve 65. In addition to helping to secure armature 64 to valve element 63, sleeve 65 may also facilitate the application of force by the spring 66 to armature 64 and valve element 63.

According to one exemplary embodiment, solenoid 67 is a device that includes a coil of wires wrapped around a core that together create a magnetic field when an electrical current is passed through the wires. Solenoid 67 is configured so that armature 64 is drawn toward solenoid 67 when the magnetic field is created. Solenoid 67 and armature 64 may be configured so that there is relatively little or no attraction of armature 64 to solenoid 67 when no electrical current is being passed through solenoid 67. Spring 66 helps to ensure that armature 64 returns to a position away from solenoid 67 when the flow of current through solenoid 67 is terminated. Spring 66 is configured to provide a biasing force that is sufficient to force armature 64 away from solenoid 67 when solenoid 67 is deactivated but which may be overcome when solenoid 67 is activated. Because armature 64 is coupled to valve element 63, the movement of armature 64 is transferred to valve element 63. Thus, when solenoid 67 is activated, armature 64 moves toward solenoid 67 causing valve element 63 to move to the closed position. When solenoid 67 is deactivated, armature 64 is pushed away from solenoid 67 by spring 66 causing valve element 63 to move to the open position. According to an alternative embodiment, the solenoid, armature, and spring may be arranged so that activation of the solenoid moves the valve element to the open position while deactivation of the solenoid allows the spring to move the valve element to the closed position. According to other alternative and exemplary embodiments, the actuator may be replaced by any suitable actuation device that controls the movement of the valve element within the aperture in the head. For example, another actuation device or configuration that may be used may include a piezo controlled actuation system, a hydraulically controlled actuation system, or any other suitable actuation system.

Although only one pump configuration was described above, it should be understood that the described pump is only one example of the many different pump types and configurations in which the control valve assembly 42 and head 32 (hereinafter referred to collectively as the head assembly) may be used. For example, while only an inline plunger or piston pump was described above, the head assembly could also be used within any one of a variety of different piston or plunger pump configurations (e.g., axial piston pump, radial piston pump, bent axis pump, inlet metered pump, outlet metered pump, etc.) and with any one of a variety of different fluids (e.g., fuel, oil, hydraulic fluid, etc.). It also should be understood that while pump 18 was described above as including two cylinders or pumping chambers 86, and consequently, two corresponding tappet assemblies 36, resilient members 40, control valve assemblies 42, and plunger assemblies 43, the pump could also be configured to include one, three, four, or more than four pumping chambers, depending on the particular application in which the pump is intended to be used.

INDUSTRIAL APPLICABILITY

Pump 18 operates to pressurize a fluid (e.g., fuel) by drawing the fluid into one or more pumping chambers 86, reducing the size of pumping chambers 86, and then forcing the fluid through an outlet to common rail 20. The way in which pump 18 operates will now be more specifically described in connection with one of pumping chambers 86. Starting from the beginning of the pumping cycle, plunger 80 is at bottom dead center and pumping chamber 86, which is normally full of fuel at this point, is at its maximum volume. As the peak of one of cam lobes 56 rotates to a position under tappet assembly 36, the cam lobe 56 forces tappet assembly 36, and therefore plunger assembly 43, upward. As plunger assembly 43 moves upward (according to the shape or contour of cam lobe 56), plunger 80 moves upward within region 76 of aperture 54 (and possibly region 74) in head 32 thereby reducing the volume of pumping chamber 86. Generally, at about the same time plunger 80 begins to move upward, solenoid 67 is energized, which has the effect of moving valve element 63 into the closed position where the pumping chamber 86 is closed off from fuel inlet passage 84. The pressure within pumping chamber 86 also helps to urge valve element 63 into the closed position. As a result of the pressure within pumping chamber 86, solenoid 67 may be deenergized during the pumping cycle without valve element 63 moving into the open position. As plunger 80 continues to move upward, the volume of pumping chamber 86 continues to reduce, which forces fuel out of pumping chamber 86 through a fuel outlet passage 85 and eventually to common rail 20. The pumping cycle continues until plunger 80 reaches top dead center, which occurs when the peak of cam lobe 56 is below tappet assembly 36. Generally, after plunger 80 reaches top dead center and begins the filling cycle, solenoid 67 is deenergized (if it wasn't already deenergized during the pumping cycle) and the pressure drops enough to allow valve element 63 to move, pursuant to the bias provided by spring 66, to the open position where fuel from fuel inlet passage 84 is again permitted to enter pumping chamber 86. As the peak of cam lobe 56 rotates past tappet assembly 36, the bias provided by resilient member 40 urges plunger assembly 43 and tappet assembly 36 back down toward camshaft 34. At this point, the backside of cam lobe 56 is below tappet assembly 36, which allows it to move back down. As plunger 80 moves downward within aperture 54 during the filling cycle, fuel continues to fill pumping chamber 86. When plunger 80 reaches bottom dead center, pumping chamber 86 will normally be full of fuel and at its maximum volume. The cycle then starts over again, with the cam lobe 56 urging tappet assembly 36 and plunger assembly 43 back up toward top dead center.

Control valve assembly 42 may be activated and deactivated at different times during the pumping and filling cycles to control how much fuel enters pumping chamber 86 during the filling cycle and/or to control whether pumping chamber 86 is coupled to fuel inlet passage 84 (which is part of a fluid circuit that flows back to transfer pump 16 and therefore acts as a drain) during all or a portion of the pumping cycle. In this way, the output of the pump may be controlled.

The head assembly described herein is intended to reduce or minimize the number of sealing interfaces that are exposed to high pressure, to reduce or minimize the number of parts that make up the head assembly, and to reduce or minimize the number of instances where the alignment of a two elements is dependent on a third element coupled between the two elements. To help accomplish this, head 32 and valve element 63 are configured so that valve element 63 is received directly within aperture 54 formed in head 32 and so that valve element 63 seals directly against a portion of head 32. By configuring head 32 and valve element 63 in this way, any parts or components that have been provided between the valve element and the head of conventional pumps can be eliminated, thereby reducing the total number of parts of the pump. Reducing the total number of parts helps to reduce the total cost of the pump. Configuring head 32 and valve element 63 in this way also results in a reduced number of sealing interfaces that are exposed to high pressure. In at least some conventional pumps, there are at least three sealing interfaces that are exposed to high pressure fluid: 1) a sealing interface between a portion of the head and an additional element that is coupled to the head and that receives the valve element, 2) a sealing interface between the valve element and the additional element that receives the valve, and 3) a sealing interface between the plunger and the bore that receives the plunger. Because head 32 directly receives valve element 63, there is no need in the pump described herein for such an additional element, and therefore no need for a sealing interface between the additional element and the head 32. The elimination of a high pressure sealing interface helps to eliminate the need for precision machining for the components that would otherwise make up that interface, which helps to reduce the overall cost of the pump. Further, with at least some conventional pumps, the alignment of two parts that form a sealing interface is dependent at least in part upon the integrity of the coupling structure (i.e., threads) used to couple the two parts together. However, manufacturing such coupling structures with the precision needed to achieve the degree of alignment that is needed to prevent, or substantially prevent, leakage at the high pressures to which the sealing interface is exposed is difficult and costly, particularly on a mass production scale. The configuration of valve element 63 and head 32 of pump 18 eliminates any reliance on a threaded interface to provide the desired alignment. Instead, alignment of the sealing interface between head 94 of valve element 63 and sealing surface 99 of head 32 is based on the alignment of body 88 of valve element 63 and region 72 of aperture 54 of head 32, which are both straight, smooth surfaces that are easier to machine within small tolerances. For at least the reasons stated above, pump 18 is believed to provide a cost effective alternative to at least some conventional pumps.

It is important to note that the construction and arrangement of the elements of the pump, including the head assembly, as shown in the exemplary and other alternative embodiments is illustrative only. Although only a few embodiments of the pump and head assembly have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, orientations, etc.) without materially departing from the novel teachings and advantages of the subject matter recited. For example, elements shown as integrally formed may be constructed of multiple parts or elements shown as multiple parts may be integrally formed, the operation of the interfaces (e.g., the interfaces between valve element, head, etc.) may be reversed or otherwise varied, and/or the length, width, or diameters of the structures and/or members or connectors or other elements of the assembly or system may be varied. It should be noted that the elements and/or assemblies of the pump, including the head assembly, may be constructed from any of a wide variety of materials that provide sufficient strength, durability, and other relevant characteristics, from any of a wide variety of different manufacturing processes, and in any of a wide variety of colors, textures, combinations, and configurations. It should also be noted that the head assembly may be used in association with various types of pumps, including a variety of different piston pumps, with a variety of different mechanisms in a variety of different applications (high pressure applications, low pressure applications, etc.), and with a variety of different fluids (e.g., fuel, oil, hydraulic fluid, transmission fluid, water, coolant, etc.) Accordingly, all such modifications are intended to be included within the scope of the present disclosure. Other substitutions, modifications, changes and omissions may be made in the design, operating conditions and arrangement of the exemplary and other alternative embodiments without departing from the spirit of the present disclosure.

What is claimed is:

1. A pump comprising:

a housing;

a driven member coupled to the housing;

a head coupled to the housing and defining a valve bore having a first diameter, a plunger bore having a second diameter, and an intermediate chamber having a third diameter, the intermediate chamber being located between the valve bore and the plunger bore;

a plunger configured to reciprocate within the plunger bore, the plunger, the plunger bore, and the intermediate chamber at least partially defining a pumping chamber; and a control valve assembly coupled to the head, the control valve assembly including an actuator moveable in response to an input signal and a valve element coupled to the actuator, the valve element being received within the valve bore and being moveable between an open position and a closed position and including a body having a fourth diameter and a valve head having a fifth diameter;

wherein the first diameter is no greater than the second diameter.

2. The pump of claim 1, wherein the fifth diameter is no greater than the second diameter.

3. The pump of claim 2, wherein the fifth diameter is greater than the first diameter.

4. The pump of claim 1, wherein the valve element includes a stem between the valve head and the body, the stem having a sixth diameter less than the fourth diameter and the fifth diameter.

5. The pump of claim 1, wherein the first diameter is smaller than the second diameter.

6. The pump of claim 1, wherein the valve head includes a first sealing surface and the head includes a second sealing surface, the first sealing surface cooperating with the second sealing surface to form a sealed interface when the valve element is in the closed position.

7. The pump of claim 6 wherein the head defines a fuel inlet passage and wherein when the valve element is in the closed position, the sealed interface is engaged and the pumping chamber is fluidly disconnected with the fuel inlet passage, and when the valve element is in the open position, the sealed interface is disengaged and the pumping chamber is fluidly connected with the fuel inlet passage.

8. The pump of claim 7, wherein the movement of the actuator causes the valve element to move between the open position and the closed position.

9. The pump of claim 8, wherein the actuator is selectively actuatable to control fluid communication between the fuel inlet passage and the pumping chamber.

10. The pump of claim 1, wherein the valve bore of the head receives the body of the valve element.

11. The pump of claim 1, wherein the head is integrally formed as a single unitary body.

12. The pump of claim 1, wherein the valve bore, the plunger bore, and the intermediate chamber sharing a common axis.

13. The pump of claim 1, wherein the plunger is coupled to the driven member and configured to reciprocate within the plunger bore in response to the movement of the driven member.

14. A pump comprising:

a housing;

a driven member coupled to the housing;

a head coupled to the housing and defining a first sealing surface, a valve bore having a first diameter, a plunger bore having a second diameter, and an intermediate chamber having a third diameter, the intermediate chamber being located between the valve bore and the plunger bore;

a plunger configured to reciprocate within the plunger bore, the plunger, the plunger bore, and the intermediate chamber at least partially defining a pumping chamber; and a control valve assembly coupled to the head, the control valve assembly including an actuator moveable in response to an input signal and a valve element coupled to the actuator, the valve element being received within the valve bore and being moveable between an open position and a closed position and including a body having a fourth diameter and a valve head having a fifth diameter, the valve head including a second sealing surface;

wherein when the valve element is in the closed position, the first sealing surface and the second sealing surface cooperate to form a sealed interface.

15. The pump of claim 14, wherein the first sealing surface defines a portion of the intermediate chamber.

16. The pump of claim 14 wherein the first diameter is no greater than the second diameter.

17. The pump of claim 14, wherein the head defines a fuel inlet passage and wherein when the valve element is in the closed position the pumping chamber is fluidly disconnected with the fuel inlet passage and when the valve element is in the open position the pumping chamber is fluidly connected with the fuel inlet passage.

18. The pump of claim 14, wherein the head is integrally formed as a single unitary body.

19. The pump of claim 14, wherein the fifth diameter is no greater than the second diameter.

20. The pump of claim 19, wherein the fifth diameter is greater than the first diameter.

21. A method of assembling a pump comprising the steps of:

providing a head having a valve bore, a plunger bore, and an intermediate chamber between the valve bore and the plunger bore;

providing a valve element including a body and a valve head;

installing the valve element within the head by sliding the body of the valve element into the plunger bore, then into the intermediate chamber, and then into the valve bore so that when the valve element is installed the valve body is received within the valve bore and the head of the valve element is received within the intermediate chamber.

22. The method of claim 21, wherein the step of providing a head further comprises the step of providing a head with a valve bore having a first diameter and a plunger bore having a second diameter, the first diameter being no greater than the second diameter.

23. The method of claim 22, wherein the step of providing a valve element further comprises the step of providing a valve element with a valve head having a third diameter, the third diameter being greater than the first diameter.

24. The method of claim 21, wherein the step of providing a head further comprises the step of providing a head with a first sealing surface, and wherein the step of providing a valve element further comprises the step of providing a valve element with a second sealing surface, the first sealing surface and the second sealing surface being configured to cooperate to form a sealed interface.

* * * * *